US005119790A

United States Patent [19]

Olson

[11] Patent Number: 5,119,790

[45] Date of Patent: Jun. 9, 1992

[54] FUEL FEED SYSTEM

[75] Inventor: Jeffrey A. Olson, Vernon Hills, Ill.

[73] Assignee: Outboard Marine Corporation, Waukegan, Ill.

[21] Appl. No.: 551,900

[22] Filed: Jul. 12, 1990

[51] Int. Cl.[5] ..... F02M 37/20

[52] U.S. Cl. ..... 123/516; 123/510; 220/746

[58] Field of Search ..... 123/510, 511, 512, 514, 123/516, 447; 220/85 US, 85 UR, 85 S

[56] References Cited

U.S. PATENT DOCUMENTS

| | | | |
|---|---|---|---|
| 1,119,980 | 12/1914 | Mulligan . | |
| 1,381,897 | 6/1921 | Ackley . | |
| 1,804,557 | 5/1931 | Gould et al. . | |
| 1,851,163 | 3/1932 | Daugherty . | |
| 2,138,069 | 11/1938 | Nicholas | 123/516 |
| 2,313,773 | 3/1943 | Samiran | 137/69 |
| 2,406,854 | 9/1946 | Samiran | 158/36.4 |
| 2,742,049 | 4/1956 | Granbert | 137/202 |
| 2,745,511 | 5/1956 | Berck | 183/2.5 |
| 2,811,219 | 10/1957 | Wenzl | 183/2.5 |
| 2,878,889 | 3/1959 | Gilbert | 183/2.5 |
| 2,917,110 | 12/1959 | Brohl | 158/36 |
| 2,998,057 | 8/1961 | Graham | 158/36.3 |
| 3,307,331 | 3/1967 | Lambert | 55/55 |
| 3,355,862 | 12/1967 | Blanchet et al. | 55/166 |
| 3,703,165 | 11/1972 | Hansen | 123/136 |
| 3,867,071 | 2/1975 | Hartley | 417/211.5 |
| 3,961,918 | 6/1976 | Johnson | 55/170 |
| 3,985,626 | 10/1976 | Klein | 202/202 |
| 4,010,012 | 3/1977 | Griffin et al. | 55/169 |
| 4,117,817 | 10/1978 | Nishida | 123/136 |
| 4,315,760 | 2/1982 | bij de Leij | 55/46 |
| 4,381,928 | 5/1983 | Roffelsen | 55/170 |
| 4,416,108 | 11/1983 | Ghandi | 123/516 |
| 4,450,820 | 5/1984 | Haynes | 123/514 |
| 4,534,774 | 8/1985 | Lecoffre et al. | 55/44 |
| 4,796,593 | 1/1989 | Woodcock | 123/516 |
| 4,809,666 | 3/1989 | Baltz | 123/510 |
| 4,860,715 | 8/1989 | Hiraku | 123/516 |

FOREIGN PATENT DOCUMENTS

| | | | |
|---|---|---|---|
| 2651459 | 5/1977 | Fed. Rep. of Germany | 123/516 |

*Primary Examiner*—Carl Stuart Miller

*Attorney, Agent, or Firm*—Michael, Best & Friedrich

[57] ABSTRACT

The invention provides a fuel feed system for an internal combustion engine, the system including a vapor separator having a wall defining a fuel chamber adapted to contain a supply of fuel and having therein an inlet, an outlet and a fuel vapor outlet, and a float drive for affording communication between the fuel vapor outlet and the chamber when the supply of fuel is below a predetermined level, the float valve including a spring engaged with a valve member for applying constant force to the valve member when the valve is closed.

13 Claims, 1 Drawing Sheet

FUEL FEED SYSTEM

BACKGROUND OF THE INVENTION

1. Field of the Invention

The invention relates generally to fuel feed systems for internal combustion engines and more particularly to fuel feed systems including vapor separators.

2. Reference to the Prior Art

Because fuel used for internal combustion engines is aromatic, fuel vapor can easily evaporate from the fuel. When fuel in a fuel feed system for an internal combustion engine is under low pressure, excessive amounts of fuel vapor can form in the fuel feed system prior to introduction of the fuel to the internal combustion engine. In order to separate accumulated fuel vapor from the fuel supply prior to introduction of the fuel to the internal combustion engine, it is generally known in the prior art to place a fuel vapor separator in the fuel supply system.

Prior art designs of fuel vapor separators can include a float which is responsive to changes in the level of fuel in a chamber for opening and closing a valve to control removal of fuel vapor from the chamber. Such prior art designs often present difficulty, however, because once the float pushes the valve against its seat, further upward travel of the float is prevented. Subsequent slight disturbances in the float position, due to bouncing and fluid sloshing, cause unwanted, intermittent openings of the vapor outlet valve. This can lead to loss of liquid fuel through the vapor outlet. Also, the float can exert excess pressure on various components of the valve, for example, a valve member and a valve seat. Bouyant and inertial forces against the float can be excessive and can cause damage to the valve member and to the valve seat and/or to the float.

Attention is directed to the fuel vapor separators disclosed in the following U.S. Patents:

| | | |
|---|---|---|
| 4,534,774 | LeCoffre et al. | August 13, 1985 |
| 4,450,820 | Haynes | May 29, 1984 |
| 4,381,928 | Roffelsen | May 3, 1983 |
| 4,315,760 | bij de Leij | February 16, 1982 |
| 4,117,817 | Nishida | October 3, 1978 |
| 4,010,012 | Griffin, III et al. | March 1, 1977 |
| 3,985,626 | Klein | October 12, 1976 |
| 3,961,918 | Johnson | June 8, 1976 |
| 3,867,071 | Hartley | February 18, 1975 |
| 3,703,165 | Hansen | November 21, 1972 |
| 3,355,862 | Blanchet et al. | December 5, 1967 |
| 3,307,331 | Lambert | March 7, 1967 |
| 2,998,057 | Graham | August 29, 1961 |
| 2,917,110 | Brohl | December 15, 1959 |
| 2,878,889 | Gilbert | March 24, 1959 |
| 2,811,219 | Wenzl | October 29, 1957 |
| 2,745,551 | Berck | May 15, 1956 |
| 2,742,049 | Granberg | April 17, 1956 |
| 2,406,854 | Samiran | September 3, 1946 |
| 2,406,854 | Samiran | March 16, 1943 |
| 1,851,163 | Daugherty | March 29, 1932 |
| 1,804,557 | Gould et al. | May 12, 1931 |
| 1,381,897 | Ackley | June 21, 1921 |
| 1,119,980 | Mulligan | December 8, 1914 |

SUMMARY OF THE INVENTION

The invention provides a vapor separator having a housing including a wall defining a fuel chamber adapted to contain a supply of fuel and having therein an inlet adapted to communicate with a source of fuel, an outlet adapted to communicate with an internal combustion engine, and a fuel vapor outlet communicable with the fuel chamber and including a valve seat, a valve member engageable with the valve seat, biasing means for moving the valve member towards, and into engagement with, the valve seat, and means for moving the valve member away from the valve seat to afford communication between the fuel vapor outlet and the fuel chamber when the level of fuel in the chamber is below a predetermined level and including lost motion means for permitting maintenance of constant force by the biasing means on the valve member when the valve member engages the valve seat.

The invention also provides a vapor separator having a housing including a wall defining a fuel chamber adapted to contain a supply of fuel, an inlet adapted to communicate with a fuel source, an outlet adapted to communicate with an internal combustion engine, a fuel vapor outlet communicable with said fuel chamber and including a valve seat, a valve member engageable with the valve seat, and means including a float for engaging the valve member with the valve seat with constant force when the supply of fuel in the chamber is above a predetermined level and for moving the valve member away from the valve seat when the supply of fuel is below a predetermined level.

The invention also provides a vapor separator comprising a housing having therein a fuel chamber for containing a supply of fuel and including a wall extending inwardly of the chamber, a fuel inlet adapted to communicate with a fuel source, a fuel outlet adapted to communicate with an internal combustion engine, and a fuel vapor outlet having therein a valve seat, a valve member engageable with the valve seat, a spring engaged with the valve member and the inwardly extending wall for biasing the valve member towards, and into engagement with, the valve seat, a float hingedly supported by the housing inside the fuel chamber, and means on the float and on the valve member for engaging the valve member and moving the valve member in a direction away from the valve seat when the supply of fuel in the chamber is below a predetermined level.

Other features and advantages of the invention will become known by reference to the following description, and claims, and the appended drawings.

Figure 1:
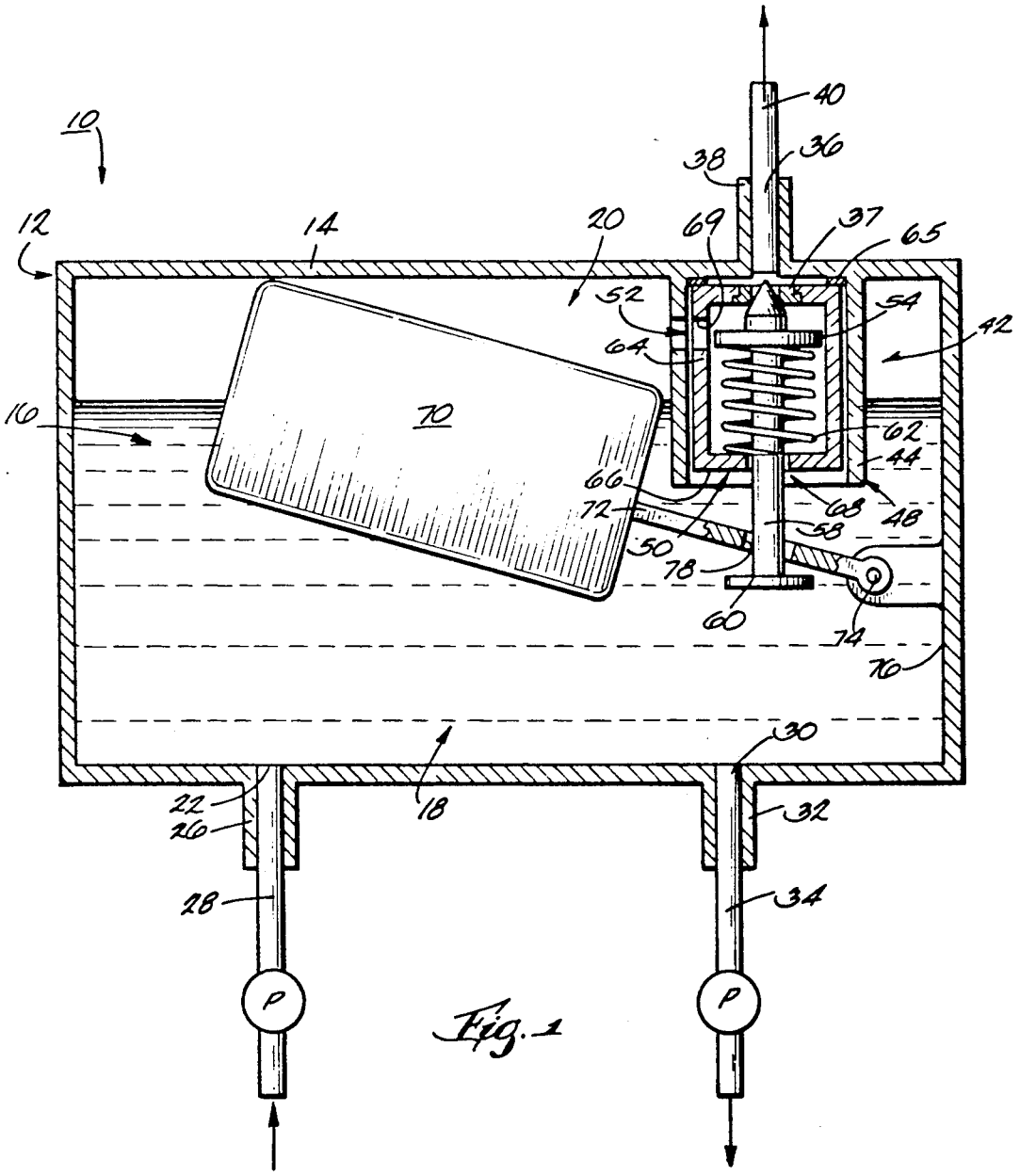
FIG. 1 is cross-sectional elevation view of a fuel vapor separator for a fuel feed system for an internal combustion engine embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Shown in FIG. 1 is a vapor separator 10 for a fuel supply system for an internal combustion engine. The vapor separator 10 is constructed to remove excess fuel vapor from the fuel supply system before introduction of the fuel to the fuel pump or other component.

While other constructions can be employed, in the disclosed construction, the fuel vapor separator 10 includes a housing 12 having a wall 14 defining a fuel chamber or reservoir 16 adapted to contain a supply of fuel. The fuel chamber 16 has a lower portion 18 and an upper portion 20.

The wall 14 has therein a fuel inlet 22 communicating with the lower portion 18 of the fuel chamber 16 and terminating on the outside of the housing 12 in the form of a nipple 26 which is adapted to be connected to an exterior fuel supply hose 28 which is, in turn, adapted to communicate with a suitable source of fuel. The wall 14 also has therein a fuel outlet 30 communicating with the lower portion 18 of the fuel chamber 16 and terminating on the outside of the housing 12 in the form of a nipple 32 which is adapted to be connected to a fuel supply hose 34 which is, in turn, adapted to communicate with the fuel pump or other component. Extending through the wall 14 is a fuel vapor passage or outlet 36 which, at one end, communicates with the upper portion 20 of the fuel chamber 16 and which, at the other end, terminates on the outside of the housing 12 in the form of a nipple 38 which is adapted to communicate with a conduit 40. In the preferred embodiment, it is contemplated that the conduit 40 will communicate with an air intake or with a crankcase in the internal combustion engine. The fuel vapor outlet 36 has therein a valve seat 37.

The wall 14 also has a portion 42 which extends inwardly into the fuel chamber 16. In the illustrated embodiment, the inwardly extending portion of the wall 42 is a generally cylindrical, hollow projection 44 which surrounds the fuel vapor outlet 36 and extends downwardly from the top of the housing 12 towards the lower portion 18 of the fuel chamber 16. The cylindrical projection 44 has an open lower end 48 communicating with an interior space 50 in the projection 44 and a hole 52 extending therethrough near the top of the fuel chamber 16 in order to assure communication between the interior 50 of the cylindrical projection 44 and the upper portion 20 of the fuel chamber 16 when the level of fuel in the fuel chamber rises above the open lower end 48 of the cylindrical projection 44.

The vapor separator 10 also includes a valve member 54 which is located inside the cylindrical projection 44 and which is engageable with the valve seat 37. The valve member 54 has a stem 58 which extends downwardly beyond the lower end 48 of the cylindrical projection 44 and into the lower portion 18 of the fuel chamber 16. The stem 58 terminates at its lower end in the form of an enlarged head or button 60.

The vapor separator 10 also includes biasing means for moving the valve member 54 towards, and into engagement with, the valve seat 37. While various other constructions could be employed, in the disclosed embodiment, the biasing means for moving the valve member 54 towards, and into engagement with, the valve seat 37 includes a spring 62 engaged with the valve member 54 and the inwardly extending portion 42 of the wall. In the illustrated embodiment, the spring 62 is located inside the cylindrical projection 44 and inside a casing 64. The casing 64 is fixed to the top of the housing 12 by means of a sealing connection 65 surrounding the fuel vapor outlet 36. The casing 64 houses the spring 62 and the valve member 54. The casing 64 has a bottom 66 which supports the spring 62 to allow the spring 62 to bias the valve member 54 towards the valve seat 37. The bottom 66 of the casing 64 also has therethrough an opening 68 which houses the stem 58 of the valve member 54. The casing 64 also has extending therethrough a hole 69 which is adjacent hole 52 in the cylindrical projection 44 to assure communication between the interior of the casing 64 and the upper portion 20 of the chamber 16.

In the illustrated embodiment, the valve seat 37 is located in the top of the casing 64 adjacent the fuel valve outlet 36. It is understood, however, that the scope of the invention includes other arrangements, such as a flange (not shown) on the lower end 48 of the inwardly extending portion 42, which could also support the spring 62, and a valve seat in the wall 14 and in the fuel vapor outlet 36.

The vapor separator 10 also includes means for moving the valve member 54 away from the valve seat 37 to afford communication between the fuel vapor outlet 36 and the fuel chamber 16 when the supply of fuel is below a predetermined level including lost motion means for permitting maintenance of constant force by the biasing means on the valve member 54 when the valve member 54 engages the valve seat 37. While various other arrangements could be used, in the disclosed embodiment, the means for moving the valve member 54 away from the valve seat 37 includes a float 70 which is hingedly supported by the wall 14 inside the fuel chamber 16. The float 70 is supported in a manner so as to be responsive to changes in the level of the supply of fuel in the fuel chamber. In this last regard, a float pivot arm 72 extends between the float 70 and a hinge 74 which is mounted on an inner surface 76 of the wall 12.

While various other constructions could be employed, in the disclosed construction, the lost motion means includes a hole 78 extending through one of the float 70 and the valve member 54 and a projection extending from the other of the float 70 and the valve member 54 and into the hole 78 to afford relative movement between the valve member 54 and the float 70 when the level of fuel in the fuel chamber 16 is above the predetermined level. In the illustrated embodiment, the float pivot arm 72 has extending therethrough a hole 78 which houses the stem 58 of the valve member 54. The hole 78 has a diameter sufficiently large to house the stem 58, but small enough to engage the button 60 at the lower end of the stem 58. The vapor separator 10 thus provides means on the float 70 and the valve member 54 for engaging the valve member 54 and for moving the valve member 54 in a direction away from the valve seat 37 when the supply of fuel is below a predetermined level.

In response to changes in the level of fuel in the fuel chamber 16, the float 70 moves the valve member 54 relative to the valve seat 37 to control the flow of fuel vapor from the fuel chamber 16. In this last regard, when the fuel in the fuel chamber 16 drops below a predetermined level, operation of the float 70 moves the valve member 54 away from the valve seat 37 to an open position, thereby opening the fuel vapor vent 36. When the fuel in the fuel chamber 16 rises to the predetermined level, the float 70 rises and allows the spring 62 to move the valve member 54 into engagement with the valve seat 37 thereby preventing passage of fuel vapor from the fuel chamber 16 into the fuel vapor outlet 36. As the level of fuel in the chamber 16 increases, the float 70 rises but does not exert pressure beyond that force supplied by the spring 62 on the valve member 54 because the hole 78 in the float pivot arm 72 allows the float 70 to rise relative to the stem 58 of the valve member 54. Thus, the fuel vapor separator 10 includes means including a float for engaging the valve member 54 with the valve seat 37 with constant force when the level of fuel in the fuel chamber 16 is above a predetermined level and for moving the valve member 54 away from the valve seat 37 when the supply of fuel in the fuel chamber 16 is below a predetermined level.

Operation of the vapor separator 10 is as follows. During periods of extended inactivity, fuel can drain from the fuel chamber 16 back to the source of fuel. Upon initiation of operation of the internal combustion engine, the fuel feed system introduces fuel from the fuel source to the fuel chamber through the fuel inlet 22.

While the supply of fuel in the fuel chamber 16 increases, but remains below a predetermined level, the float 70 is at a relatively low position so that the float pivot arm 72 engages the button 60 at the lower end of the valve stem 54. The weight of the float 70 operates against the spring 62 to move the valve member 54 away from the valve seat 37 so that the valve member 54 remains in an open position to afford communication between the upper portion 20 of the fuel chamber 16 and the fuel vapor outlet 36.

As the level of the fuel in the fuel chamber 16 increases to the predetermined level, the float 70 rises in response to the increasing level of fuel, and allows the spring 62 to move the valve member 54 towards, and into engagement with, the valve seat 37, thereby preventing passage of fuel vapor from the fuel chamber 16 through the fuel vent outlet 36. As the fuel level rises, the pressure within the vapor separator 10 increases until it reaches a level determined by the fuel feed system. The fuel level never becomes so high that liquid fuel can escape through the fuel vapor outlet 36.

During normal operation of the internal combustion engine, the flow of fuel from the inlet 22 into the fuel chamber 16 and into the outlet 30 is uninterrupted by operation of the fuel vapor separator 10. Depending upon the output pressure of the fuel supply system and the demand for fuel by the engine, the level of fuel in the fuel chamber 16 can rise above the predetermined level. As the level of fuel in the fuel chamber 16 rises, the float 70 rises but does not exert additional pressure on the valve member 54 and valve seat 37 because the stem 58 and the float 70 can move relative to one another when the level of fuel is above the predetermined level.

As fuel vapor emanates from the supply of fuel, the vapor collects in the upper portion 20 of the fuel chamber 16 and the pressure thereof effects lowering of the level of the supply of fuel in the fuel chamber. As the amount of fuel vapor in the fuel chamber 16 grows, or upon demand of fuel by the internal combustion engine exceeding the capacity of the fuel supply system, the level of fuel in the fuel chamber 16 drops. The float 70 will fall in response to the decreasing level of fuel and, when the level of fuel falls to the predetermined level, the float pivot arm 72 will engage the stem 58 of the valve member 37 to move the valve member 54 away from the valve seat 37 and to an open position to afford passage of fuel vapor from the fuel chamber 16 through the hole 52 and through the fuel vapor vent 36. Fuel vapor can escape from the fuel chamber until the level of fuel in the fuel chamber increases to the predetermined level, whereafter, in response to the increasing level of fuel, the float 70 rises and the spring 62 moves the valve member 54 back into engagement with the valve seat 37.

Various of the features of the invention are set forth in the following claims.

I claim:

1. A vapor separator comprising a housing defining a fuel chamber adapted to contain a supply of fuel and having therein an inlet adapted to communicate with a source of fuel, an outlet adapted to communicate with an internal combustion engine, and a fuel vapor outlet communicable with said fuel chamber and including a valve seat located in said fuel vapor outlet, a valve member engageable with said valve seat, biasing means engaged between said valve member and a fixed portion of said housing for maintaining said valve member in engagement said valve seat such that said valve member is held against said valve seat with a constant force when the level of fuel in said float chamber is above a predetermined level, and means for positively displacing said valve member away from said valve seat against the action of aid biasing means to disengage said valve member from said valve seat and thereby afford communication between said fuel vapor outlet and said fuel chamber when the level of fuel in said fuel chamber is below said predetermined level and including lost motion means for permitting maintenance of said engagement of said valve member with said valve seat by said biasing means under constant force when the fuel level is above said predetermined level.

2. A vapor separator as set forth in claim 1 wherein said means for moving said valve member away from said valve seat includes a float structure hingedly supported by said housing inside said chamber for movement in response to changes in the level of the fuel in said chamber, and wherein said valve member and said float structure are connected by said lost motion means.

3. A vapor separator as set forth in claim 1 wherein said fixed portion of said housing includes an inwardly extending wall portion and wherein said biasing means for moving said valve member includes a spring engaged with said valve member and said inwardly extending wall portion.

4. A vapor separator as set forth in claim 1 wherein said lost motion means includes a hole in one of said float structure and said valve member, and a projection extending from the other of said float structure and said valve member and into said hole to afford relative movement between said valve member and said float structure when the level of fuel in said chamber is above the predetermined level.

5. A vapor separator comprising a housing defining a fuel chamber adapted to contain a supply of fuel, a fuel inlet communicating with said fuel chamber and adapted to communicate with a fuel source, a fuel outlet communicating with said fuel chamber and adapted to communicate with an internal combustion engine, a fuel vapor outlet communicable with said fuel chamber independently of the communication of said fuel inlet with said fuel chamber and including a valve seat, a valve member engageable with said valve seat, and a spring engaged between a fixed portion of said housing and said valve member for engaging said valve member with said valve seat such that said valve member is held against said valve seat with constant force when the supply of fuel in the chamber is above a predetermined level, and a float structure operably connected to aid valve member and operable against the action of said spring for positively displacing said valve member away from said valve seat when said supply of fuel is below the predetermined level.

6. A vapor separator as set forth in claim 5 wherein said float structure is hingedly supported inside said chamber by said housing for movement in response to changes in the level of the supply of fuel in said chamber, and wherein said valve member is directly engageable with said float structure.

7. A vapor separator as set forth in claim 5 wherein said fixed portion of said housing includes an inwardly extending wall portion, and wherein said spring extends between said valve member and said inwardly extending wall portion.

8. A vapor separator as set forth in claim 7 wherein one of said float structure and said valve member has therein a hole, and wherein the other of said float structure and said valve member includes a projection extending into said hole to afford relative movement between said valve member and said float structure when the level of fuel in said chamber is above the predetermined level.

9. A vapor separator comprising a housing having therein a fuel chamber for containing a supply of fuel and including a fixed wall extending inwardly of said chamber, a fuel inlet adapted to communicate with a fuel source, a fuel outlet adapted to communicate with an internal combustion engine, and a fuel vapor outlet having therein a valve seat, a valve member engageable with said valve seat, a spring engaged between said valve member and said inwardly extending wall for biasing said valve member towards, and into engagement with, said valve set, a float structure hingedly supported by said housing within said fuel chamber, means engaged between said fixed wall and said valve seat for biasing said valve member into engagement with said valve seat such that said valve member is held against said valve seat with a constant force, and means on said float and on said valve member for affording lost motion therebetween when the supply of fuel in the fuel chamber is above a predetermined level and for positively displacing said valve member against the action of said biasing means and in a direction away from said valve seat when the supply of fuel in the fuel chamber is below said predetermined level, said lost motion means including a hole in one of said float structure and said valve member and a projection extending from the other of said float structure and said valve member and into said hole, said hole being elogated relative to said projection to afford relative movement between said float structure and said valve member when the fuel in said fuel chamber is above said predetermined level.

10. A vapor separator comprising a housing defining a fuel chamber adapted to contain a supply of fuel, a fuel inlet communicating with said fuel chamber and adapted to communicate with a fuel source, a fuel outlet communicating with said fuel chamber and adapted to communicate with an internal combustion engine, a fuel vapor outlet communicable with said fuel chamber independently of the communication of said fuel inlet with said fuel chamber and including a valve seat, a valve member engageable with said valve seat, and a spring engaging said valve member with said valve seat such that said valve member is held against said valve seat with constant force when the supply of fuel in the chamber is above a predetermined level, and a float structure operable against the action of said spring for moving said valve member away from said valve seat when said supply of fuel is below the predetermined level.

11. A vapor separator as set forth in claim 10 wherein said float structure is hingedly supported inside said chamber by said housing for movement in response to changes in the level of the supply of fuel in said chamber, and wherein said valve member is directly engageable with said float structure.

12. A vapor separator as set forth in claim 5 wherein said housing includes an inwardly extending wall portion, and wherein said spring extends between said valve member and said inwardly extending wall portion.

13. A vapor separator as set forth in claim 12 wherein one of said float structure and said valve member has therein a hole, and wherein the other of said float structure and said valve member includes a projection extending into said hole to afford relative movement between said valve member and said float structure when the level of fuel in said chamber is above the predetermined level.

* * * * *